United States Patent [19]

Schröder

[11] Patent Number: 4,465,025

[45] Date of Patent: Aug. 14, 1984

[54] STEAM GENERATOR

[76] Inventor: Hans J. Schröder, Schumannstr. 27, D-4150 Krefeld, Fed. Rep. of Germany

[21] Appl. No.: 483,675

[22] Filed: Apr. 11, 1983

[30] Foreign Application Priority Data

Apr. 17, 1982 [DE] Fed. Rep. of Germany ..... 3214228

[51] Int. Cl.[3] ..... F22B 5/02

[52] U.S. Cl. ..... 122/19; 122/161; 122/235 R; 126/361

[58] Field of Search ..... 122/13 R, 14, 16, 17, 122/18, 19, 23, 29, 160, 161, 235 R, 250 R; 126/350 R, 361

[56] References Cited

U.S. PATENT DOCUMENTS

| | | | |
|---|---|---|---|
| 2,832,320 | 4/1958 | Thome et al. | 122/161 |
| 3,650,248 | 3/1972 | Miller | 122/235 R |
| 3,707,142 | 12/1972 | Kobayashi | 126/85 B |
| 4,282,833 | 8/1981 | Giesen | 122/161 |
| 4,366,778 | 1/1983 | Charrier et al. | 122/17 |
| 4,387,669 | 6/1983 | Brown | 122/13 R |

*Primary Examiner*—Edward G. Favors
*Assistant Examiner*—Steven E. Warner
*Attorney, Agent, or Firm*—Ernest F. Marmorek

[57] ABSTRACT

A steam generator has a wound flow pipe which forms an enclosure structure that surrounds an inner chamber, an inner housing which surrounds the jacket and forms therewith a first annular gap for guiding exhaust gas from a burner, an intermediate housing which surrounds the inner housing and forms therebetween a second annular gap through which a combustion air flows to the burner and is heated by the exhaust gas in the first annular gap, and an outer housing which surrounds the intermediate housing and forms a third annular gap through which the combustion air is aspirated from the third gap and is preheated by the combustion air in the second annular gap.

9 Claims, 2 Drawing Figures

STEAM GENERATOR

BACKGROUND OF THE INVENTION

The present invention relates to steam generators. More particularly, it relates to a steam generator which has a spirally wound flow pipe provided with a water inlet and a steam outlet and that forms an enclosure structure which bounds a hollow inner space, at least one oil or gas burner having its exhaust directed into the hollow space, an inner housing which surrounds the jacket with a bottom distance therefrom and a first annular gap therebetween so that the first gap communicates with an exhaust gas opening, and an intermediate housing which surrounds the inner housing also with a bottom distance therefrom and a second annular gap therebetween, so that the second gap communicates with a blower for supplying combustion air to the burner.

The steam generator is formed as a fully automatic device. After turning on a water pump and completely filling the flow pipe with water, as well as after attaining a predetermined water pressure, the burner is set into operation with simultaneous air supply, and steam will be generated. A pressure regulator, pressure maintaining valves, a pressure limiting member, a starting pressure valve and a temperature limiting member are used for regulating the steam generation and steam temperature, so that the regulation of the fuel supply and combustion air supply are performed automatically and constantly maintain the steam generation, the steam pressure and the temperature at adjusted values. Preheated water with temperatures of approximately between 90° C. and 100° C. is supplied into the flow pipe in such steam generators, especially in the region of water inlet of the pipe, to avoid that the temperature falls below the point of condensation, therefore to avoid any resulting corrosion phenomena.

In the steam generators known heretofore, the blower aspirates the combustion air from the surrounding atmosphere and guides it through the second annular gap between the inner housing and the intermediate housing upwardly to the burner. The combustion air which flows upwardly through the second annular gap is preheated through the wall of the inner housing by smoke or combustion gases which flow in the first annular gap between the inner housing and the jacket formed by the spirally wound flow pipe upwardly to the exhaust gas outlet conduit.

SUMMARY OF THE INVENTION

It is an object of the present invention to improve the efficiency, particularly of the burner used for the heating of the water in the spirally wound flow pipe.

More particularly, it is an object of the present invention to improve the efficiency of the burner by using the available heat energy without any additional energy consumption, for a further temperature increase of the combustion air supplied to the burner.

In keeping with these objects and with others which will become apparent hereinafter, one feature of the invention resides, briefly stated, in a steam generator which is provided with an outer housing that surrounds the intermediate housing and forms with the latter a third annular gap for aspirating therethrough a combustion air from the aspiration opening to the blower. The third annular gap can be connected at its upper end with the aspiration opening and at its lower end with a suction side of the blower.

In the known steam generators the combustion air is aspirated directly from the surrounding atmosphere. In contrast, in the steam generator in accordance with the present invention, the combustion air is aspirated through the third gap formed by the additional housing and flows in a counterstream to the combustion air which flows in the second annular gap to the burner. Therefore, the combustion air arrives at the suction side of the blower already in a preheated state. Thus, radiation heat which in the known steam generators was lost into the surrounding atmosphere is used in the instant steam generator for preheating the combustion air aspirated by the blower.

The novel features which are considered as characteristic for the invention are set forth in particular in the appended claims. The invention itself, however, both as to its contruction and its method of operation, together with additional objects and advantages thereof, will be best understood from the following description of specific embodiments when read in connection with the accompanying drawings.

DESCRIPTION OF A PREFERRED EMBODIMENT

Figure 1:
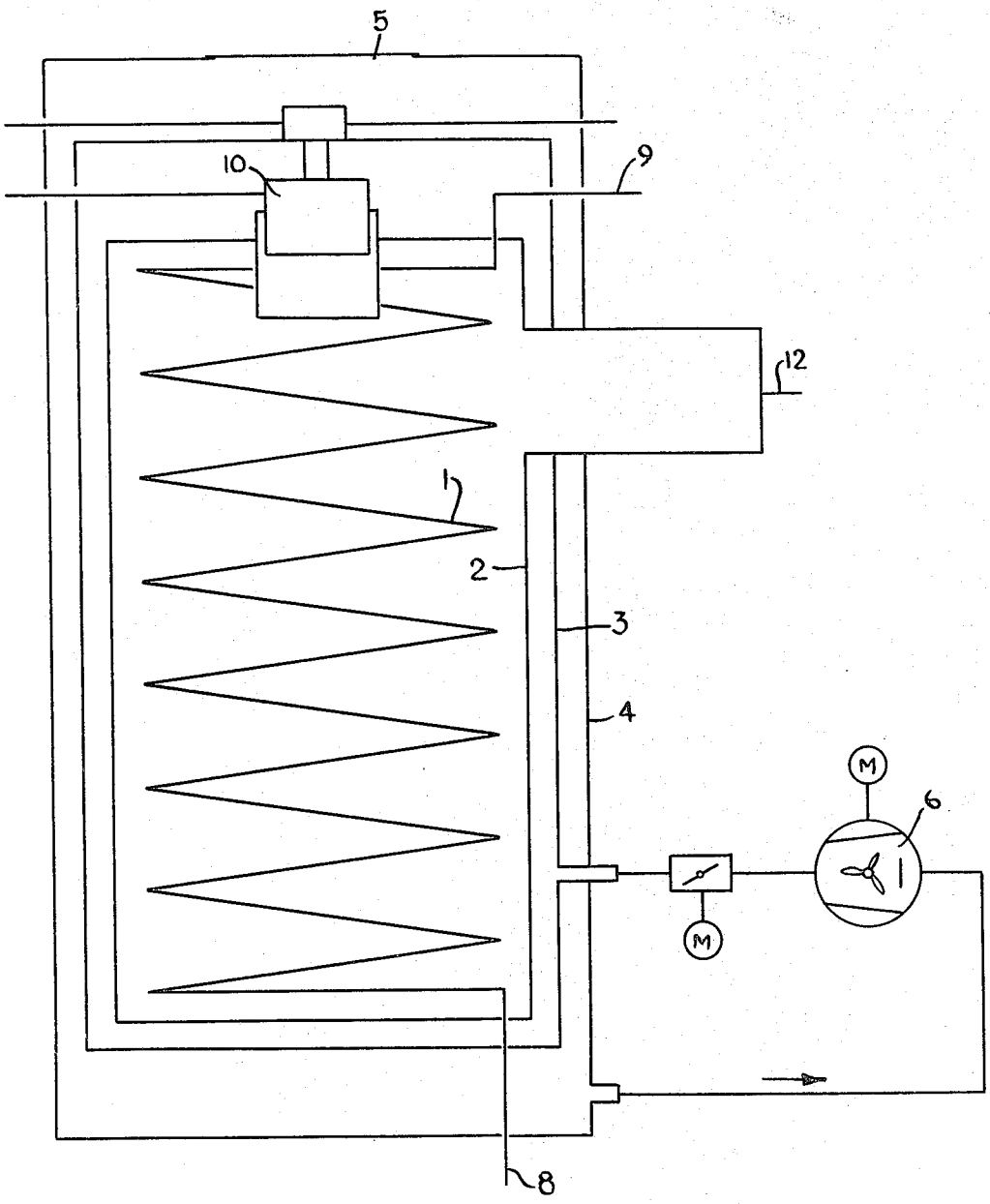
FIG. 1 is a schematic sectional view of a steam generator in accordance with the present invention.
Figure 2:
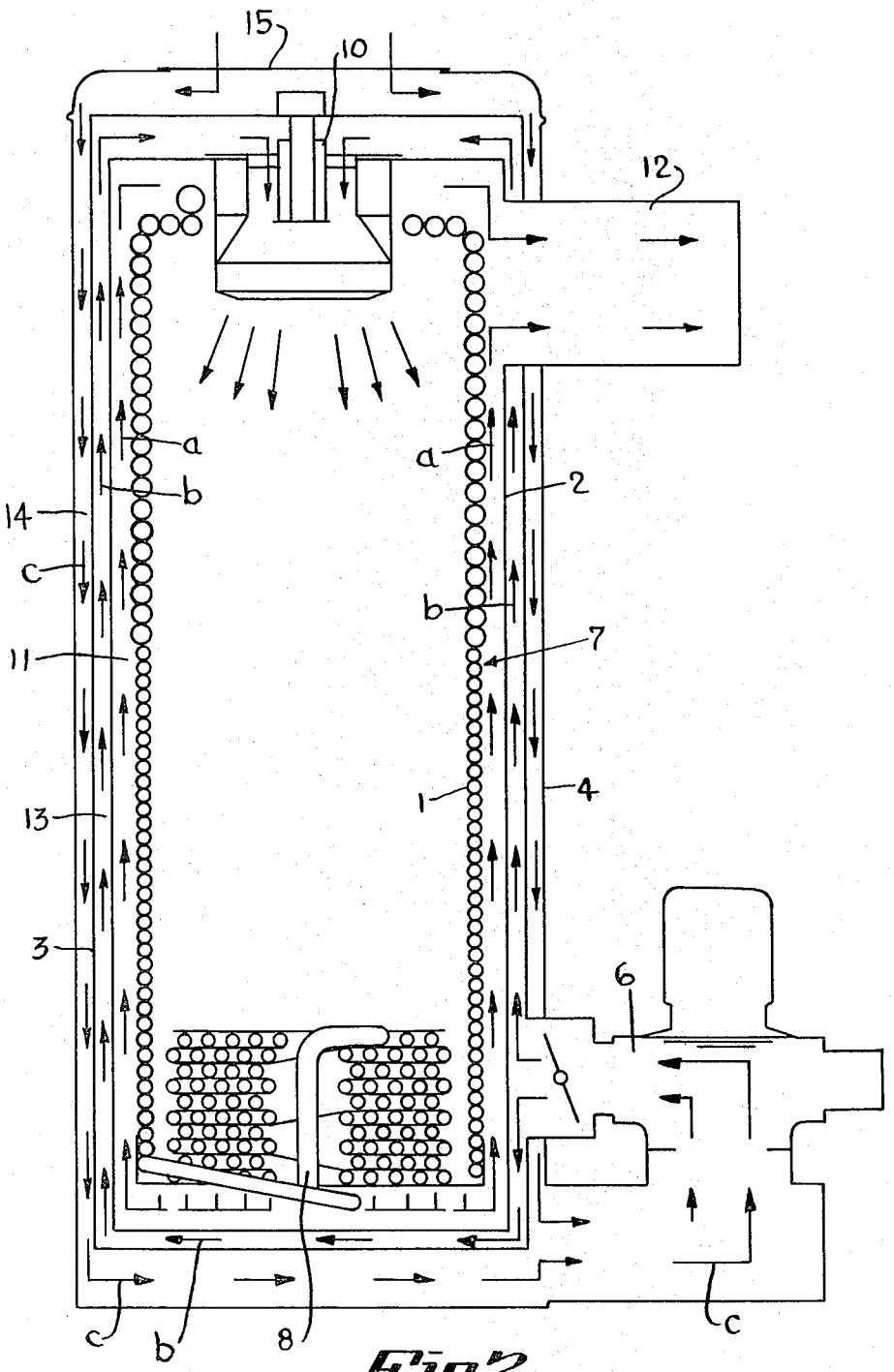
FIG. 2 is a schematic vertical sectional view similar to the view of FIG. 1, but showing further details of the instant steam generator.

The steam generator in accordance with the invention has a flow pipe 1 which is wound spirally in one or several layers and forms an enclosure structure such as a closed jacket 7. The lower end of the flow pipe 1 is connected to a water inlet 8 and the upper end of the flow pipe is connected to a steam outlet 9.

An oil or gas burner 10 is directed into a hollow space which is limited by the jacket 7. Fuel and combustion gas of the burner 10 is directed into the hollow space and thereby flows downwardly over the inner surface of the jacket 7 which is formed by the flow pipe 1. The jacket 7 which limits the hollow space is surrounded by an inner housing 2 which is arranged at a bottom distance from the jacket and forms with the latter a first annular gap or inner chamber 11. The inner housing 2 is connected at its upper end with an exhaust gas outlet conduit 12 for an exhaust gas which flows upwardly in the first annular gap 11 in direction of the arrow "a".

The inner housing 2 is surrounded by an intermediate housing 2 which is arranged with a bottom distance and a top distance from the inner housing 2 and forms with the latter a second annular gap or intermediate chamber 13. The second annular gap is connected in the region of its upper end with the suction side of a blower 6. It is also connected at its lower end with the burner 10, so as to supply the combustion air to the burner 10 in direction of the arrow "b". The combustion air which flows in direction of the arrow "b" in the second annular gap 13 is heated by the exhaust gas which flows upwardly in the first annular gap 11 in direct stream (in the same direction).

The intermediate housing 3 is surrounded by an outer housing 4 which is arranged with a bottom distance and a top distance from the intermediate housings and defines with the latter an annular third gap or outer chamber 14. The outer housing 4 is provided at its upper side with an aspiration opening 5 arranged for aspirating the combustion air and preferably closed by a filter or grate 15. The outer housing 4 is connected at its lower end to the suction side of the blower 6. The combustion air is aspirated from the surrounding atmosphere and flows through the third annular gap 14 in direction of the arrow "C". It flows in counterstream with the (heated) combustion air which flows in the second annular gap 13, and is thereby being preheated by the same. As a result of this, the combustion air supplied for burning is heated in the instant steam generator to a higher degree than in known steam generators, and hence the efficiency of the burner is increased.

I wish it to be understood that I do not desire to be limited to the exact details of construction shown and described, for obvious modifications will occur to a person skilled in the art.

Having thus described the invention, what I claim as new and desire to be secured by Letters Patent, is as follows:

1. A steam generator, comprising:

a water flow pipe having a water inlet and a steam outlet for generating steam in said flow pipe, said flow pipe forming an enclosure structure defining a combustion space;

a burner arranged in said combustion space for heating water in said flow pipe by the emission of exhaust gases;

an inner housing surrounding said enclosure structure defining therewith an inner chamber provided with an exhaust gas outlet for passing exhaust gases from said burner through said inner chamber and into said exhaust gas outlet;

an intermediate housing surrounding said inner housing defining therewith an intermediate chamber through which combustion air is supplied to said burner;

an outermost housing surrounding said intermediate housing defining therewith an outer chamber provided with an aspiration opening;

a blower, having a suction side and an outlet side, wherein the suction side is connected to the outer chamber and the pressure side to the intermediate chamber, forcing combustion air flowing from the aspiration opening through the outer chamber to the suction side of the blower, and from the pressure side of the blower into and through the intermediate chamber to the burner, thus generating exhaust gases which are directed through the combustion space into and through the inner chamber to the exhaust gas outlet;

whereby the combustion air is preheated in two temperature drop stages in that the exhaust gases in the inner chamber will pre-heat the combustion air flow in the intermediate chamber, and the preheated combustion air in the intermediate chamber will pre-heat the fresh incoming combustion air in the outer chamber.

2. A steam generator as claimed in claim 1, wherein the interconnections between the chambers and the blower are so arranged that the combustion air from the aspiration opening flows toward the blower through the outer chamber in one direction, the combustion air in the intermediate chamber flows from the blower in a direction opposite to the one direction, and the exhaust gases in the inner chamber flow in a direction opposite to the one direction.

3. A steam generator as defined in claim 1, wherein said flow pipe is spiral-shaped.

4. A steam generator as defined in claim 1, wherein said burner is an oil burner.

5. A steam generator as claimed in claim 1, wherein said burner is a gas burner.

6. A steam generator defined in claim 1, wherein said inner chamber between said enclosure structure and said inner housing has a circumferential annular gap portion and a bottom portion and an upper end portion communicating with said exhaust gas outlet.

7. A steam generator as claimed in claim 1, wherein said intermediate chamber between said inner housing and said intermediate housing has a circumferential annular portion and a bottom portion a lower end portion in communication with said blower.

8. A steam generator as defined in claim 1, wherein said outer chamber between said intermedate housing and said outermost housing has a circumferential annular portion, a bottom portion and a top portion.

9. A steam generator as claimed in claim 8, wherein said outer chamber has an upper end portion connected with said aspiration opening and a lower end portion communicating with said suction side of said blower.

* * * * *